US007255623B2

(12) United States Patent
Davis

(10) Patent No.: US 7,255,623 B2
(45) **Date of Patent: *Aug. 14, 2007**

(54) SELF-STABILIZING ROTATING TOY

(76) Inventor: Steven Davis, Suite 701-3 Wing On Plaza, 62 Mody Road, TST East (HK)

( * ) Notice: Subject to any disclaimer, the term of this patent is extended or adjusted under 35 U.S.C. 154(b) by 303 days.

This patent is subject to a terminal disclaimer.

(21) Appl. No.: 11/106,146

(22) Filed: Apr. 14, 2005

(65) Prior Publication Data

US 2005/0173589 A1 Aug. 11, 2005

Related U.S. Application Data

(63) Continuation of application No. 10/924,357, filed on Aug. 24, 2004, now Pat. No. 6,899,586, which is a continuation of application No. 10/647,930, filed on Aug. 26, 2003, now Pat. No. 6,843,699, which is a continuation-in-part of application No. 09/819,189, filed on Mar. 28, 2001, now Pat. No. 6,688,936.

(60) Provisional application No. 60/453,283, filed on Mar. 11, 2003.

(51) Int. Cl.
*A63H 27/00* (2006.01)

(52) U.S. Cl. ..... 446/36; 446/37; 244/23 C

(58) Field of Classification Search ..... 446/37, 446/46, 48; 244/12.2–12.3, 21, 39, 23 C, 244/23 R, 46, 48; D21/444, 441
See application file for complete search history.

(56) References Cited

U.S. PATENT DOCUMENTS

| | | | | |
|---|---|---|---|---|
| 32,272 A | | 5/1861 | Benton | |
| 693,328 A | | 2/1902 | Morgan | |
| 1,260,957 A | | 3/1918 | Benjamin | 446/41 |
| 1,907,815 A | | 5/1933 | Hough | 446/41 |
| 2,051,151 A | | 8/1936 | Northrop | 446/40 |
| D172,112 S | | 5/1954 | Shoemaker | |
| 2,949,693 A | | 8/1960 | McRoskey | |
| D193,245 S | | 7/1962 | Knox | |
| 3,104,853 A | | 9/1963 | Klein | |
| D209,763 S | | 1/1968 | Mueller | |
| D210,791 S | | 4/1968 | Tally et al. | |
| D211,104 S | | 5/1968 | Steadman | |
| 3,394,906 A | * | 7/1968 | Rogers | 244/23 R |
| D213,708 S | | 4/1969 | Blumenthal | |
| D214,577 S | | 7/1969 | Mueller | |
| 3,549,109 A | | 12/1970 | Gilstrap | |
| 3,568,358 A | | 3/1971 | Bruce | 446/37 |
| 3,570,467 A | | 3/1971 | Belokin | |
| D221,453 S | | 8/1971 | Swanberg | |

(Continued)

*Primary Examiner*—Robert E. Pezzuto
*Assistant Examiner*—Alex F. R. P. Rada, II

(57) ABSTRACT

A rotating toy may then include a hub having a central axis and a lower portion; a plurality of counter rotating blades extending outwardly from the lower portion of the hub, the plurality of counter rotating blades having a tip connected to an outer ring; a single means for rotating the hub and blades sufficiently quickly to generate a major portion of the lift generated by the aircraft through the single rotating means; and the hub having an upper portion above the plurality of counter rotating blades and above the single rotating means such that the aircraft includes a center of gravity above a bottom portion defined by the outer ring to improve self stabilization of the toy. In furtherance thereto the single rotating means may be secured on the central axis and positioned below the counter rotating blades.

40 Claims, 6 Drawing Sheets

U.S. PATENT DOCUMENTS 3,727,055 A 4/1973 David et al.
3,935,663 A 2/1976 Leibowitz
4,065,873 A 1/1978 Jones
D253,525 S 11/1979 Wilson
4,184,654 A 1/1980 Herrera
4,249,334 A 2/1981 Goldfarb et al.
D261,538 S 10/1981 Sides
4,313,512 A 2/1982 Jutras
4,452,174 A 6/1984 Fedder ..... 222/57
4,828,525 A 5/1989 Okano
4,923,303 A 5/1990 Lutz
4,931,028 A 6/1990 Jaeger et al.
4,995,822 A 2/1991 Sutour
5,071,383 A 12/1991 Knoshita
5,080,624 A 1/1992 Brinker
5,297,759 A * 3/1994 Tilbor et al. ..... 244/17.11
5,362,065 A 11/1994 Su
5,407,151 A 4/1995 Singhal
5,429,542 A 7/1995 Britt, Jr.
5,452,907 A 9/1995 Nakada et al.
5,492,494 A 2/1996 Keennon
5,634,839 A 6/1997 Dixon
5,672,086 A 9/1997 Dixon
5,726,928 A 3/1998 Imai et al. ..... 310/114
5,971,320 A 10/1999 Jermyn et al.
6,182,923 B1 2/2001 Weinhart
6,389,329 B1 5/2002 Colens ..... 700/262
6,398,159 B1 6/2002 Di Stefano
6,428,381 B1 8/2002 Stern
6,450,446 B1 9/2002 Holben
6,457,670 B1 10/2002 Geranio et al.
6,513,752 B2 2/2003 Carter, Jr.
6,550,715 B1 4/2003 Reynolds et al.
6,604,706 B1 8/2003 Bostan
6,616,094 B2 9/2003 Illingworth
6,843,699 B2 * 1/2005 Davis ..... 446/37
6,899,586 B2 * 5/2005 Davis ..... 446/37
2001/0024923 A1 9/2001 Streit
2002/0104921 A1 8/2002 Louvel
2002/0142699 A1 10/2002 Davis
2003/0111575 A1 6/2003 Rehkemper et al.

* cited by examiner

SELF-STABILIZING ROTATING TOY

CROSS REFERENCE TO RELATED APPLICATIONS

This application is a continuation of Ser. No. 10/924,357 filed Aug. 24, 2004 now U.S. Pat. No. 6,899,586. Application Ser. No. 10/924,357 is a continuation of application Ser. No. 10/647,930 filed Aug. 26, 2003, now U.S. Pat. No. 6,843,699. U.S. Pat. No. 6,843,699 claims the benefit of U.S. Provisional Application 60/453,283 filed on Mar. 11, 2003; and U.S. Pat. No. 6,843,699 is a Continuation In Part Application of application Ser. No. 09/819,189 filed Mar. 28, 2001, now U.S. Pat. No. 6,688,936.

FIELD OF THE INVENTION

This invention relates generally to toys and more particularly to directionally uncontrollable self-stabilizing rotating toys.

BACKGROUND OF THE INVENTION

Most vertical takeoff and landing aircraft rely on gyro stabilization systems to remain stable in hovering flight. For instance, applicant's previous U.S. Pat. No. 5,971,320 and International PCT application WO 99/10235 discloses a helicopter with a gyroscopic rotor assembly. The helicopter disclosed therein uses a yaw propeller mounted on the frame of the body to control the orientation or yaw of the helicopter. However, different characteristics are present when the body of the toy, such as a flying saucer model, rotates as gyro stabilization systems may not be necessary when the body rotates, for example, see U.S. Pat. Nos. 5,297,759; 5,634,839; 5,672,086; and U.S. Pat. No. 6,843,699.

However, a great deal of effort is made in the following prior art to eliminate or counteract the torque created by horizontal rotating propellers in flying aircraft in order to replace increased stability by removing gyro-stabilization systems. For example, Japanese Patent Application Number 63-026355 to Keyence Corp. provides a first pair of horizontal propellers reversely rotating from a second pair of horizontal propellers in order to eliminate torque. See also U.S. Pat. No. 5,071,383 which incorporates two horizontal propellers rotating in opposite directions to eliminate rotation of the aircraft. Similarly, U.S. Pat. No. 3,568,358 discloses means for providing a counter-torque to the torque produced by a propeller because, as stated in the '358 patent, torque creates instability as well as reducing the propeller speed and effective efficiency of the propeller.

The prior art also includes flying or rotary aircraft which have disclosed the ability to stabilize the aircraft without the need for counter-rotating propellers. U.S. Pat. No. 5,297,759 incorporates a plurality of blades positioned around a hub and its central axis and fixed in pitch. A pair of rotors pitched transversely to a central axis to provide lift and rotation are mounted on diametrically opposing blades. Each blade includes turned outer tips, which create a passive stability by generating transverse lift forces to counteract imbalance of vertical lift forces generated by the blades, which maintains the center of lift on the central axis of the rotors. In addition, because the rotors are pitched transversely to the central axis to provide lift and rotation, the lift generated by the blades is always greater than the lift generated by the rotors.

Nevertheless, there is always a continual need to provide new and novel self-stabilizing rotating toys that do not rely on additional rotors to counter the torque of a main rotor.

Such a need should include a single main rotor to generate a major portion of the lift. Such self-stabilizing rotating toys should be inexpensive and relatively noncomplex.

SUMMARY OF THE INVENTION

In accordance with the present invention a self-stabilizing rotating flying toy that includes a main rotor is attached to a main body with a plurality of blades fixed with respect to the main body. The blades and main body rotate in a opposite direction caused by the torque of a motor mechanism used to rotate the main rotor positioned below the blades. The blades extend from a inner hub to an outer ring. The main hub connected above the inner hub is positioned above the blades and main body such that the Center of Gravity is above the center of lift, to provide a self-stabilizing rotating toy.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE EMBODIMENTS

Figure 1:
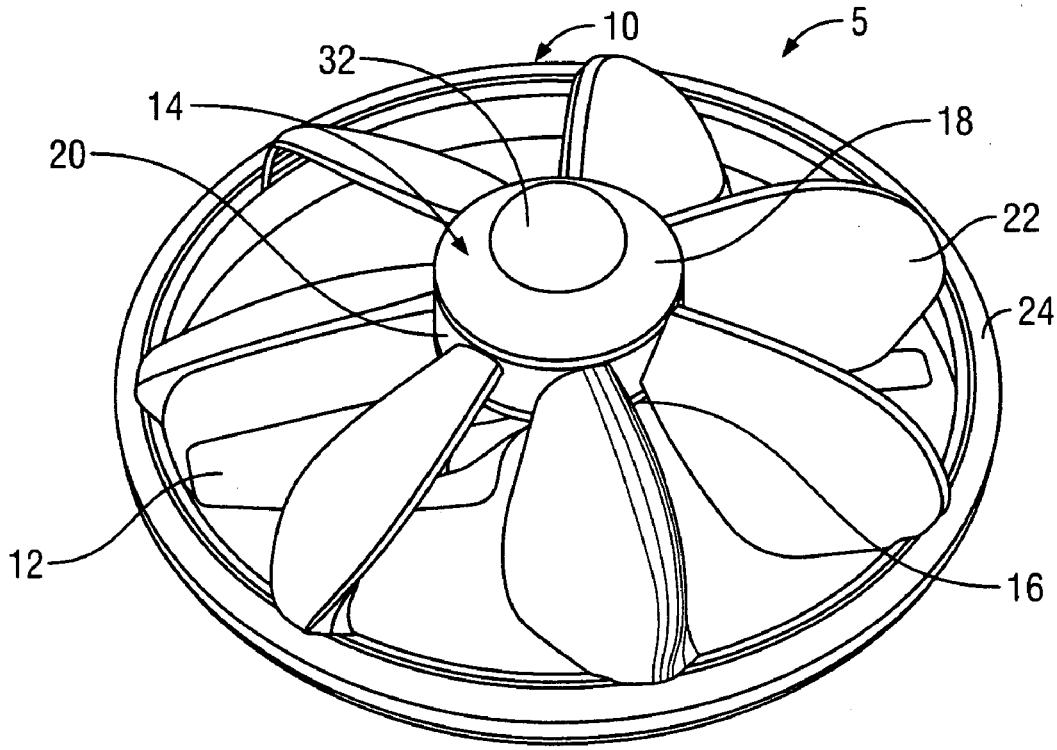
FIG. 1 is a perspective view of a flying rotating toy in accordance with the preferred embodiment of the present invention.

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention and/or claims of the embodiments illustrated.

Figure 2:
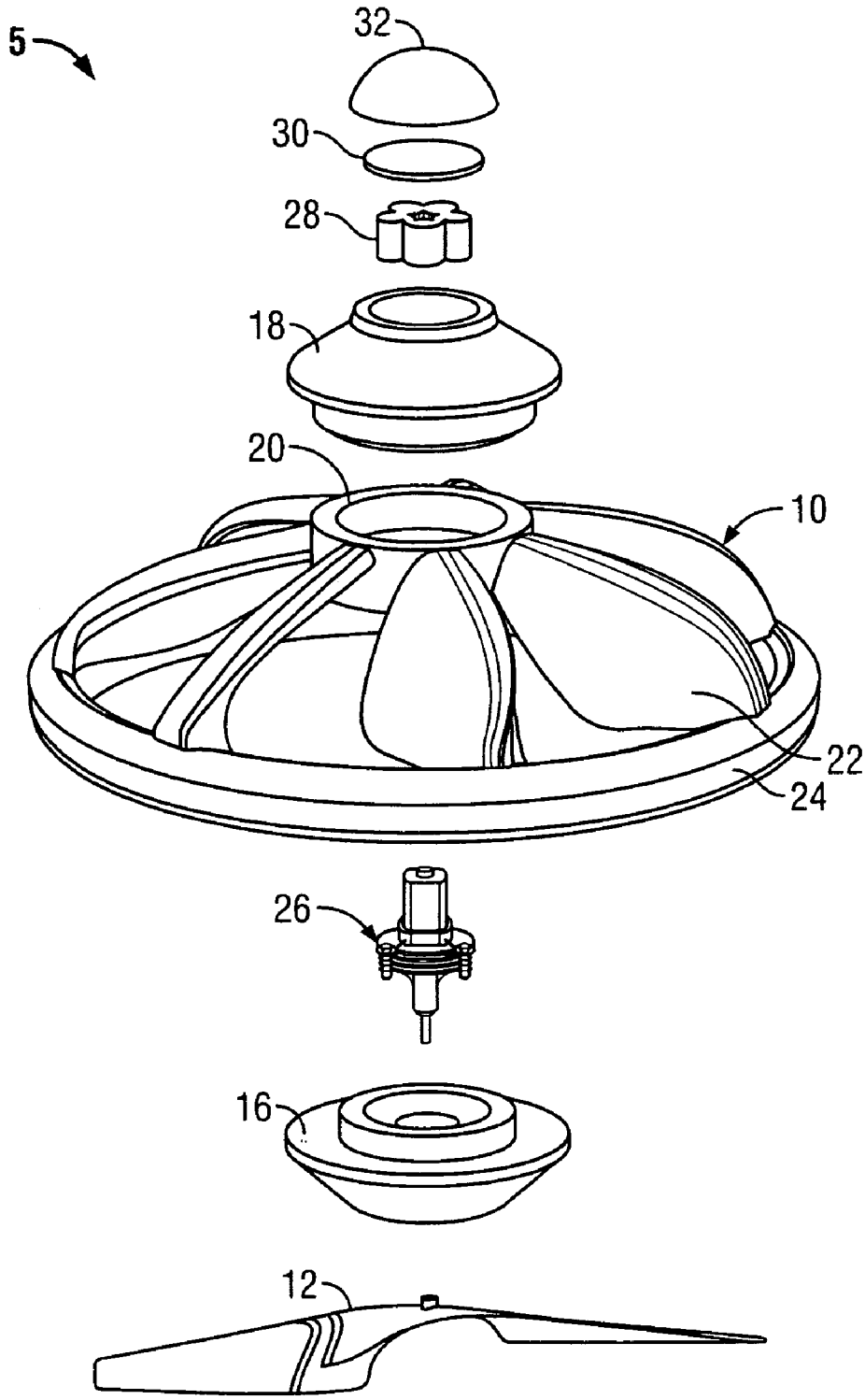
FIG. 2 is an exploded view of the flying rotating toy from FIG. 1.

Referring to FIGS. 1 and 2, in a first embodiment of the present invention a flying rotating toy 5 is provided. The rotating toy 5 includes a single main rotor 12 rotatably attached to a light weight counter rotating main body 10. The counter rotating main body 10 includes a hub 14 that contains the drive and control mechanisms. The hub 14 is defined as having a lower hub section 16 and an upper hub section 18 that are received by an inner hub 20. A plurality of blades 22 extend outwardly and downwardly from the hub 14 to an outer ring 24. The lower hub section 16 houses a motor mechanism 26 that is used to rotate a main rotor 12, while the upper hub section 18 houses at least a power supply 28 and a circuit board 30. A clear dome 32 is positioned on top of the upper hub section 18 to protect the components and to provide a means for the reception of wireless signals, discussed in greater detail below.

Figure 3:
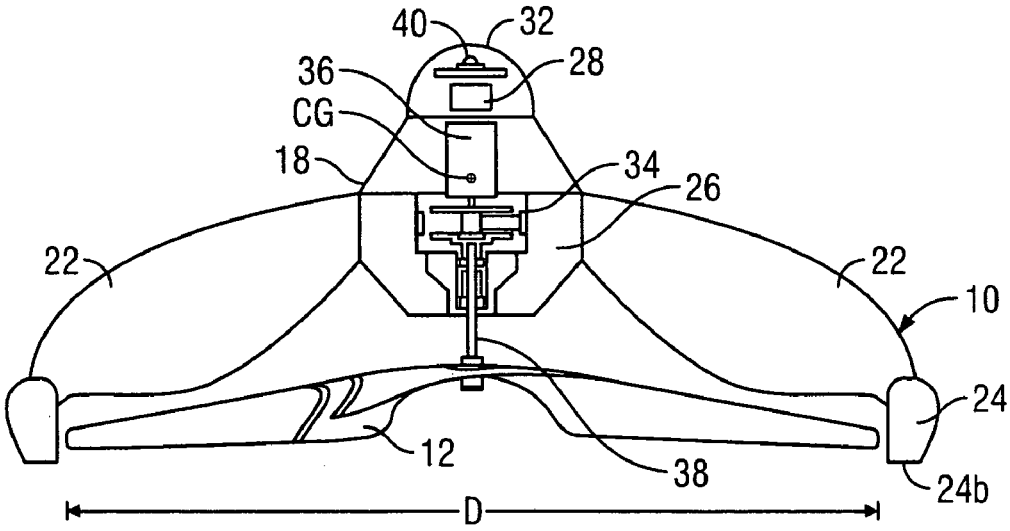
FIG. 3 is a sectional view of the flying rotating toy from FIG. 1.

Further reference is made to the cross sectional view of the rotating toy 5 illustrated in FIG. 3. The motor mechanism 26 is a planetary reduction gear box 34 that includes a motor 36. The planetary gear box 34 permits the motor mechanism 26 to be mounted along a single axis aligned with an axle 38 that is connected to the main rotor 12.

Figure 4:
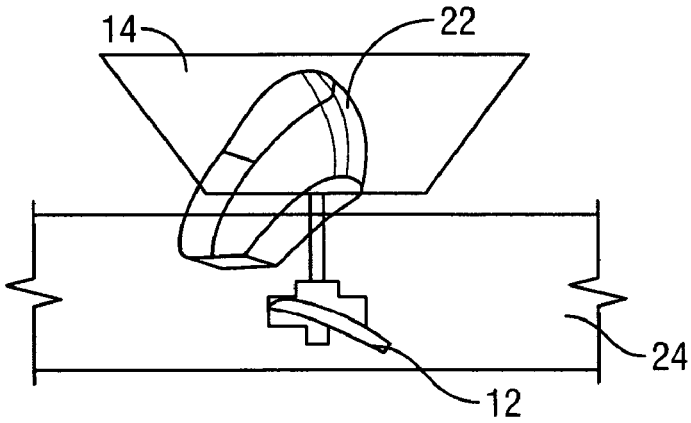
FIG. 4 is a partial sectional view of the relationship between the counter rotating blades and the main rotor.

As the main rotor 12 rotates, no attempt is made to counter the torque from driving the main rotor 12, instead the torque causes the main body 10 to rotate in the opposite direction. Once the toy is flying the outer ring 24 protects the main rotor 12 and provides gyroscopic stability. As mentioned above, the outer ring 24 and hub 14 are connected by a plurality of blades 22 with lifting surfaces positioned to generate lift as the toy 5 rotates. Since the blades 22 are rotating in the opposite direction as the main rotor 12 but both are providing lift to the toy 5, the blades 22 are categorized as counter-rotating lifting surfaces. (The inter-relationship between the counter rotating blades and the main rotor is illustrated in partial sectional view FIG. 4.) The induced drag characteristics of the main rotor 12 verses the blades 22 can also be adjusted to provide the desired body rotation speed.

The rotating toy 5 of the present invention has the ability to self stabilize during rotation. This self stabilization is categorized by the following: as the rotating toy 5 is perturbed in someway it tilts to one direction and starts moving in that direction. A blade, of the plurality of blades 22, that is on the higher or preceding side of the rotating toy (since the rotating toy is tilted) will get more lift than the one on the lower or receding side. This happens because the preceding blade will exhibit a higher inflow of air. Depending on the direction of rotation the lift is going to be on one side or the other. This action provides a lifting force that is 90 degrees to the direction of travel and creates a gyroscopic procession with a reaction force that is 90 degrees out of phase with the lifting force such that the rotating toy 5 self-stabilizes. The self-stabilizing effect is thus caused by the gyroscopic procession and the extra lifting force on the preceding blade. For the self-stabilizing effect to work the gyroscopic procession forces generated by the rotating body must dominate over the gyroscopic procession forces generated by the main propeller 12.

The placement of the center of gravity (CG, FIG. 3) above the center of lift was found to be very critical for the self-stabilizing effect. Experiments showed that the self-stabilizing effect depended on the aerodynamic dampening and on the relative magnitudes of the aforementioned forces. It was thus determined that the self-stabilizing effect was best when the CG is positioned above the bottom position 24*b* of the outer ring 24, preferably at a distance which is equal to about ⅓ to ½ the diameter D of the main rotor 12 and most preferred when the distance is about 65% of the main rotor 12 radius (½ D). (It is noted that the diameter of the main rotor 12 is equal to the length of the two blades, from tip to tip). It should also be noted that the cross sectional shape of the outer ring 24 and the height of the CG are inter dependent and very critical to the stability. It was also found that if the CG is higher, the rotating toy 5 becomes unstable and if the CG is lower, the rotating toy becomes unstable. And if the rotating toy 5 becomes unstable, the rotating toy will not self stabilize, meaning that it will just spiral further and further out of control as the rotating toy 5 flies off into a larger and larger oscillations.

Since it is most preferred to place the CG about 65% of the main rotor radius above the bottom of the outer ring 24, most of the components are placed above the main body 10. The motor 36 thus drives the main rotor 12 through a longer driveshaft. In addition, the weight contributes to the CG placement, thus, it is preferred to have the main body 10 including the blades 22 made from a light weight material.

The present invention is also particularly stable because there is a large portion of aerodynamic dampening caused by the blades 22. As mentioned above, the entire blades 22 are curved and turned downwardly from the hub 14 to an outer ring 24, and preferably inclined downwardly at about 20 to 30 degrees, which may be measured by drawing an imaginary line through an average of the curved blades. This causes dampening that resists sideward motion in the air because there's a large frontal area to the blades.

During operation, the main rotor 12 is spinning drawing the air above the toy downwardly through the counter rotating blades 22 within the outer ring 24. The air is thus being conditioned by the blades before hitting the rotor. By conditioning the air it is meant that the air coming off the blades 22 is at an angle and at an acceleration, as opposed to placing the main rotor in stationary air and having to accelerate the air from zero or near zero. The efficiency of the main rotor 12 is thereby increased. It was found that the pitch on the main rotor 12 would have to be a lot shallower if the blades 22 were not positioned above the main rotor.

During various experiments the main rotor 12 and the main body 10 were rotated separately and together at about 600 rpms and the lift generated by the main rotor 12 and main body 10 were measured. It was found that when rotated separately, the main rotor 12 only generated about 60% of the lift exhibited by the combination of the main rotor 12 and the body 10 (with blades 22). However, it would be incorrect to state that the blades 22 generate the remaining 40% of the lift, because it was also found that the blades 22 spinning at the same speed by themselves only generated about 5 to 10% of the lift exhibited by the combination. Since separately the main rotor generated 60% and the blades generated 5 to 10% there is 30-35% of lift unaccounted. However, when the main rotor 12 is rotating separately the air that it is using is unconditioned or static (zero acceleration). Since the blades 22 are positioned on top of the main rotor 12, the blades 22 will still only generate 5-10% of the lift in the combined state; concluding that the blades 22 increase the efficiency of the main rotor by conditioning the air before it is used by the main rotor 12. Thus the combination of the two (the main rotor 12 and the blades 22) must generate the additional 30-35% of the lift when acting in concert and utilizing the conditioned air.

Figure 5:
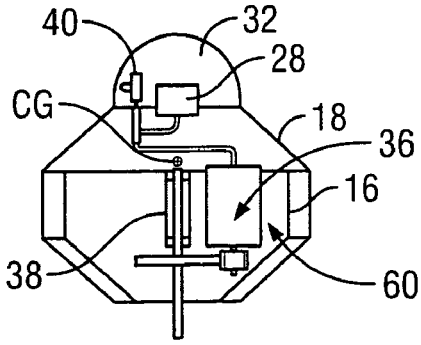
FIG. 5 is a cross sectional view of another gear reduction box which may be incorporated by the present invention illustrating a dome section with a off-center motor placement.

In another embodiment, an offset reduction gear box 60 (FIG. 5) may also be used that have an offset motor 36 mounted off of the axle 38. In an offset mount, a counter-weight (not shown) may be placed on the outer ring 24 about 180 degrees from the motor, to keep the balance of the rotating toy centered.

Figure 6:
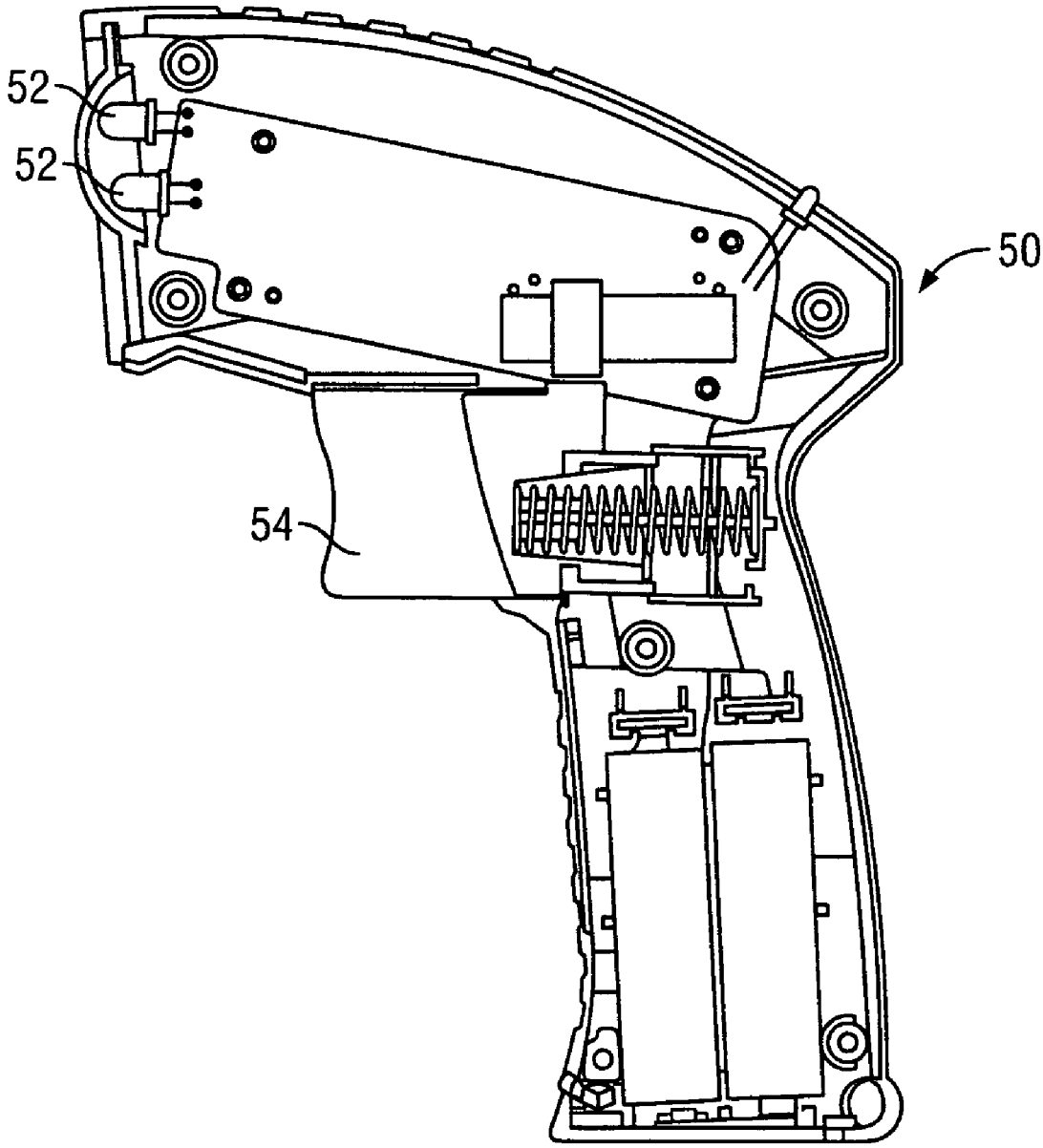
FIG. 6 is a cross sectional view of a trigger mechanism designed to remotely control the speed of the motor mechanism.
Figure 7:
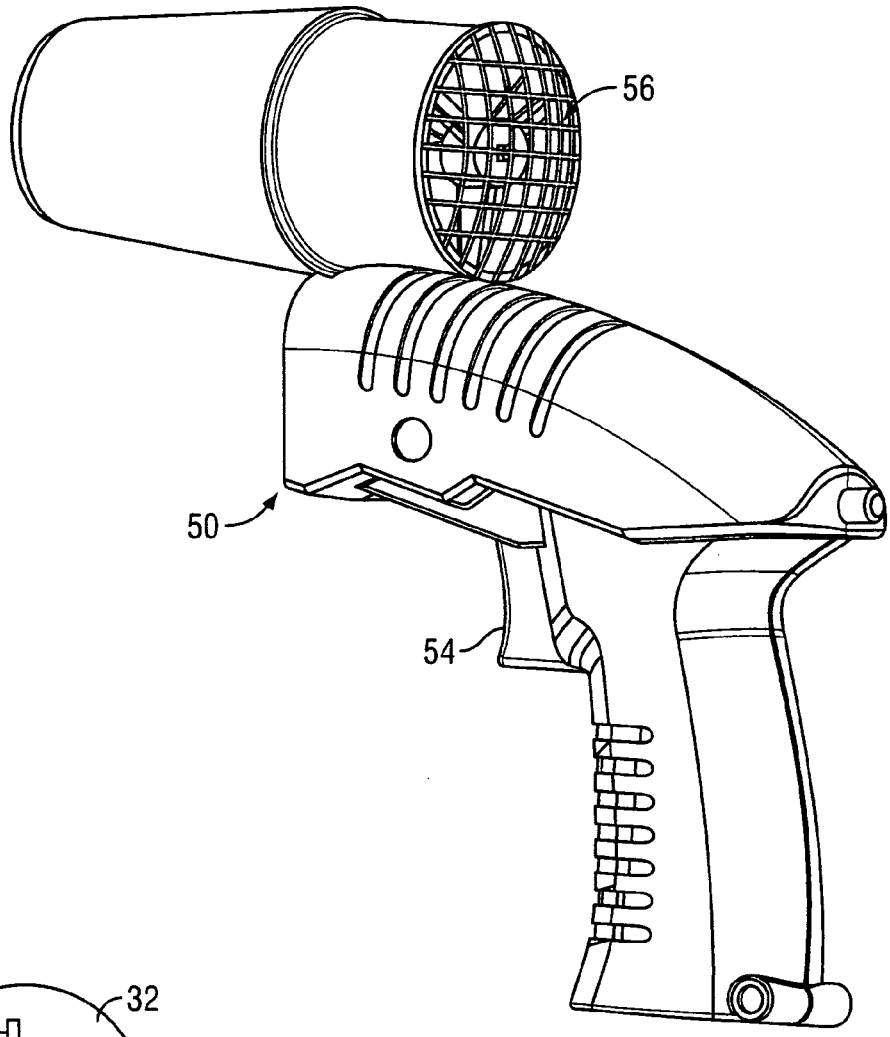
FIG. 7 is another trigger mechanism incorporating a fan or blower to move the rotating toy during operation.

To control the motor mechanism 26 an IR sensor 40 or receiver is positioned in the dome 32 and is used in concert with an outside remote IR transmitter. The transmitter 52 may be positioned in a remote control unit 50, illustrated in FIG. 6. The remote control unit 50 has a simple trigger mechanism 54 designed to emit a signal when pushed inwardly by the user's finger. In addition, the self stabilizing effect will cause the rotating toy 5 to stabilize even when pushed by air currents, which will initially move the rotating toy 5 but eventually the toy 5 will stabilize to a substantially horizontal flying position. Referring to FIG. 7, the remote control mechanism 50 may include a fan 56 that is able to be activated by the user. Activating the fan 56 will permit the user to blow a stream of air at the rotating toy 5 and push it around, providing a simple means of moving the rotating toy around. It is well known in the art and contemplated by the present invention that the transmitter and receivers can be radio, infrared or optical.

Figure 9:
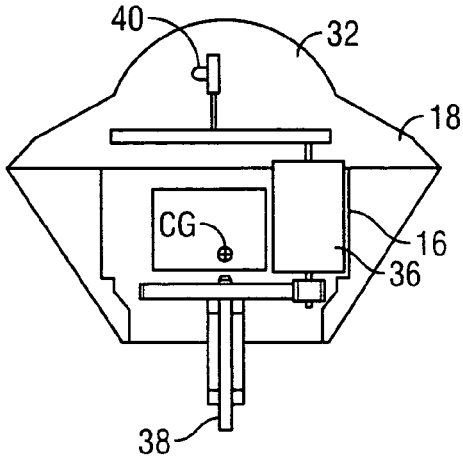
FIG. 9 shows a cross section view of a gear reduction box used in the embodiment of FIG. 8.
Figure 8:
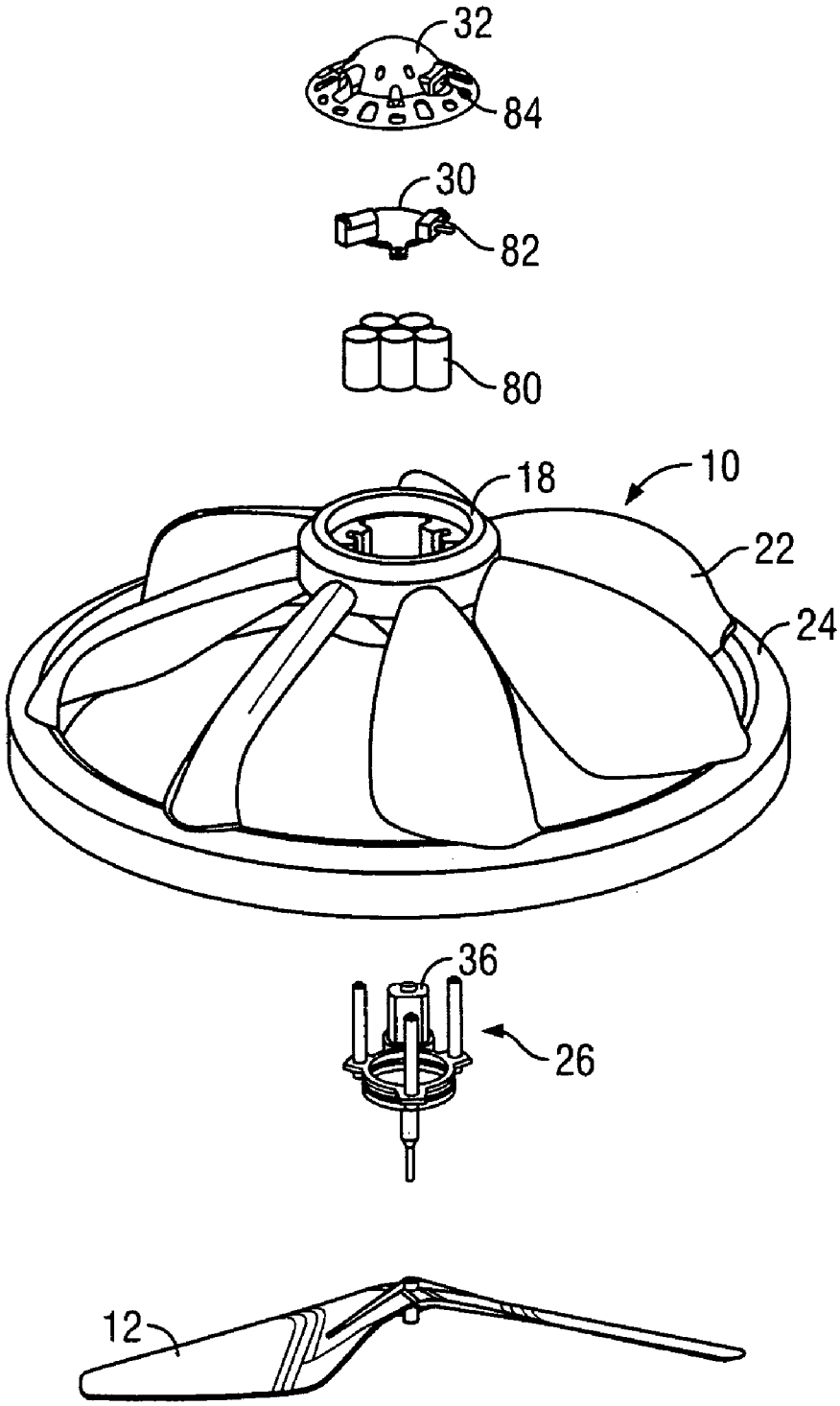
FIG. 8 shows an exploded perspective view of another embodiment of the present invention.

In another embodiment of the present invention, referred to FIGS. 8 and 9, a battery pack 80 is used to counter the weight of an offset motor 36. As illustrated, the battery pack 80 is arranged such that a motor 36 in the motor mechanism 26 is offset to counter balance each other such that the rotating toy is balanced. Moreover, in this embodiment the upper hub section 18 and the lower hub section 16 are integrally formed as a single piece; and an on/off switch 82 is attached to the circuit board 30 and positioned to be manipulated by a user through an aperture 84 in the dome 32.

It should be further stated the specific information shown in the drawings but not specifically mentioned above may be ascertained and read into the specification by virtue of simple study of the drawings. Moreover, the invention is also not necessary limited by the drawings or the specification as structural and functional equivalents may be contemplated and incorporated into the invention without departing from the spirit and scope of the novel concept of the invention. It is to be understood that no limitation with respect to the specific methods and apparatus illustrated herein is intended or should be inferred. It is, of course, intended to cover by the appended claims all such modifications as fall within the scope of the claims.

I claim:

1. A rotating toy comprising:

a hub having a bottom portion;

an outer ring having a diameter larger than a diameter defined by the hub and the outer ring having a bottom portion positioned below the bottom portion of the hub;

a plurality of blades extending outwardly from the hub and each blade, of the plurality of blades, having an end connected to the outer ring, each blade having an underside portion;

a motor mechanism substantially housed within the hub; and a main rotor rotated by the motor mechanism and suspended below the hub and having ends that extend past a perimeter defined by the hub such that the ends of the main rotor when rotating are suspended below the underside portion of the plurality of blades, the main rotor when rotating rotates in a first direction and a torque created by the rotation thereof rotates the hub, blades, and outer ring in a direction opposite the first direction, and the main rotor when rotated sufficiently causes the toy to rotate and fly.

2. The rotating toy of claim 1, wherein the hub includes an upper portion above the plurality of counter rotating blades and above the main rotor such that the toy includes a center of gravity above a bottom portion of the outer ring.

3. The rotating toy of claim 2, wherein the center of gravity is positioned above the bottom portion of the outer ring at a distance that is between about ⅓ to ½ a diameter defined by the main motor.

4. The rotating toy of claim 2 further comprising a dome positioned on an upper portion of the hub.

5. The rotating toy of claim 1, wherein the motor mechanism rotates a drive shaft connected to the main rotor.

6. The rotating toy of claim 1, wherein the main rotor has a diameter less than an internal diameter defined by the outer ring.

7. The rotating toy of claim 1 further comprising a wireless controller that controls a rotational speed of the main rotor.

8. The rotating toy of claim 1, wherein said end of each blade, of the plurality of blades, includes a first portion connected to said outer ring and includes a second portion positioned about a circumference defined by an internal diameter of said outer ring.

9. A rotating toy comprising: a hub; a plurality of counter rotating lifting blades extending outwardly from the hub, each counter rotating lifting blade, of said plurality of counter rotating lifting blades, includes an end connected to an outer ring; a main rotor positioned below the hub for generating a major portion of the lift therethrough such that the toy is able to fly; and a center of gravity positioned above a bottom portion defined by the outer ring along a central axis defined by the hub.

10. The toy of claim 9, wherein the main rotor includes a diameter less than an internal diameter defined by the outer ring.

11. The toy of claim 9 further comprising a motor mechanism for driving the main rotor, and an internal space defined by the hub for housing at least a portion of the motor mechanism.

12. The toy of claim 9, wherein the bottom portion of the outer ring is below the lower portion of the hub.

13. The toy of claim 12, wherein each blade of the plurality of counter rotating lifting blades, has a downwardly and an outwardly slope from said hub to said outer ring.

14. The toy of claim 9 further comprising a control mechanism for controlling the rotational speed of said main rotor.

15. The toy of claim 14, wherein said control mechanism is controlled through a wireless controller.

16. The toy of claim 15, wherein said wireless controller is an infrared wireless controller.

17. A rotating toy in combination with a remote controller comprising:

the rotating toy including a hub having a cavity and a lower portion; a plurality of counter rotating lifting blades extending outwardly and downwardly from the hub to an outer ring, the outer ring having a bottom portion positioned below the lower portion of the hub; a motor mechanism substantially housed within the hub rotates a shaft extending from said motor mechanism, a main rotor secured to the shaft below the lower portion of the hub, and a receiver in communication with the motor mechanism to receive commands for controlling a rotational speed of the main rotor, wherein the rotating toy has a center of gravity positioned above the bottom portion of the outer ring and wherein the main rotor when rotated sufficiently causes the rotating toy to fly; and the remote controller including a transmitter for sending commands to the receiver that control the rotational speed of the rotating toy.

18. The rotating toy of claim 17, wherein the outer ring includes an internal diameter larger than a diameter defined by the main rotor.

19. The toy of claim 17, wherein said transmitter is an infrared transmitter and the receiver is an infrared receiver.

20. A hovering toy comprising:

a hub having a central axis, and an internal space;

a plurality of counter rotating lifting blades extending outwardly and downwardly from the hub;

an outer ring having a bottom portion positioned below the hub, the outer ring being connected to the plurality of counter rotating lifting blades;

a motor mechanism substantially housed in the internal space of the hub, the motor mechanism drives a shaft that extends downwardly from the hub along the central axis;

a main rotor secured to the shaft such that the main rotor is positioned below the hub; and a center of gravity defined by the hovering toy positioned above the bottom portion of the outer ring.

21. The rotating toy of claim 20, wherein the center of gravity is positioned above the bottom portion of the outer ring at a distance that is about ⅓ a diameter defined by the main motor.

22. The hovering toy of claim 20, wherein the main rotor has a diameter less than an internal diameter defined by the outer ring.

23. The hovering toy of claim 20, further comprising a dome positioned on an upper portion defined by said hub.

24. The toy of claim 20 further comprising a control mechanism for controlling the rotational speed of said main rotor.

25. The toy of claim 24, wherein said control mechanism is controlled through a wireless controller.

26. The toy of claim 25, wherein said wireless controller is an infrared wireless controller.

27. The rotating toy of claim 20, wherein each blade, of the plurality of counter rotating blades, includes an end having a first portion connected to said outer ring and having a second portion positioned about a circumference defined by an internal diameter of said outer ring.

28. A rotating toy comprising: a hub; an outer ring having a bottom portion positioned below the hub; a plurality of blades extending outwardly from the hub, the plurality of blades each having an end connected to the outer ring; a motor mechanism substantially housed within the hub; and a main rotor positioned below the hub and connected to the motor mechanism such that the motor mechanism is able to rotate said main rotor sufficiently to cause the rotating toy to fly wherein the main rotor has a diameter greater than a perimeter defined by the hub and less than an internal diameter defined by the outer ring.

29. The rotating toy of claim 28, wherein the hub includes an upper portion above the plurality of counter rotating blades and above the main rotor.

30. The rotating toy of claim 29 further comprising a center of gravity above a bottom portion of the outer ring.

31. The rotating toy of claim 30, wherein the center of gravity is positioned above the bottom portion of the outer ring at a distance that is about ⅓ a diameter defined by the main motor.

32. The toy of claim 28, wherein each blade of the plurality of counter rotating lifting blades, has a downwardly and an outwardly slope from said hub to said outer ring.

33. The toy of claim 28 further comprising a control mechanism for controlling the rotational speed of said main rotor.

34. The toy of claim 33, wherein said control mechanism is controlled through a wireless controller.

35. The toy of claim 34, wherein said wireless controller is an infrared wireless controller.

36. A rotating toy comprising:

a hub;

an outer ring having a bottom portion;

a plurality of counter-rotating blades extending outwardly from the hub, the plurality of blades each having an end connected to the outer ring;

a rotating means positioned below the hub and rotatably connected thereto and wherein the rotating means has a diameter greater than a perimeter defined by the hub; and a rotational mechanism for rotating the rotating means sufficiently to cause the toy to rotate and fly.

37. The rotating toy of claim 36 further comprising a center of gravity above a bottom portion of the outer ring.

38. The toy of claim 36, wherein each blade of the plurality of counter rotating lifting blades, has a downwardly and an outwardly slope from said hub to said outer ring.

39. The toy of claim 36 further comprising a control mechanism for controlling the rotational speed of the rotating means.

40. The toy of claim 39, wherein said control mechanism is controlled through an infrared wireless controller.

* * * * *